US007611361B2

(12) United States Patent
Kondo et al.

(10) Patent No.: US 7,611,361 B2
(45) Date of Patent: Nov. 3, 2009

(54) CONTACT, AND ELECTRIC CONNECTOR USING THE SAME

(75) Inventors: Hayato Kondo, Yao (JP); Takayuki Nagata, Yao (JP)

(73) Assignee: Hosiden Corporation, Yao-Shi (JP)

( * ) Notice: Subject to any disclaimer, the term of this patent is extended or adjusted under 35 U.S.C. 154(b) by 0 days.

(21) Appl. No.: 12/144,881

(22) Filed: Jun. 24, 2008

(65) Prior Publication Data

US 2009/0017692 A1 Jan. 15, 2009

(30) Foreign Application Priority Data

Jul. 13, 2007 (JP) ..... 2007-184075

(51) Int. Cl.
*H01R 12/00* (2006.01)

(52) U.S. Cl. ..... 439/79; 439/733.1

(58) Field of Classification Search ..... 439/79, 439/733.1

See application file for complete search history.

(56) References Cited

U.S. PATENT DOCUMENTS 4,802,860 A * 2/1989 Kikuta ..... 439/79
5,152,700 A * 10/1992 Bogursky et al. ..... 439/733.1
5,882,214 A * 3/1999 Hillbish et al. ..... 439/79
6,071,152 A * 6/2000 Achammer et al. ..... 439/733.1
7,044,752 B2 * 5/2006 Olson et al. ..... 439/79

FOREIGN PATENT DOCUMENTS

JP 2003-505826 2/2003
WO WO 01/06602 A1 1/2001

* cited by examiner

*Primary Examiner*—Tho D Ta
(74) *Attorney, Agent, or Firm*—Kratz, Quintos & Hanson, LLP

(57) ABSTRACT

The invention provides a substantially L-shaped contact to be inserted into and held in a terminal insertion hole formed in a body of an electric connector. The contact includes a main portion to be press-fitted into a terminal insertion hole formed in a body of an electric connector; a bent portion continuous to a portion of a rear end of the main portion; a lead-out portion continuous to a rear end of the bent portion; and an extension portion projecting from a remaining portion of the rear end of the main portion in a longitudinal direction of the main portion. The extension portion serves as a pressed portion to be inserted into the terminal insertion hole together with the bent portion.

6 Claims, 9 Drawing Sheets

(a)

(b)

CONTACT, AND ELECTRIC CONNECTOR USING THE SAME

The present application claims priority under 35 U.S.C. §119 of Japanese Patent Application No. 2007-184075 filed on Jul. 13, 2007, the disclosure of which is expressly incorporated by reference herein in its entity.

BACKGROUND OF THE INVENTION

1. Field of the Invention

The present invention relates to a contact arranged inside of a body of an electric connector and to an electric connector using the same.

2. Description of the Related Art

A known contact of this type is a substantially L-shaped conductive member, including a main portion to be press-fitted into a terminal insertion hole formed inside a body of an electric connector, a bent portion continuous to the main portion, and a lead-out portion continuous to the bent portion, as disclosed in Japanese Unexamined Patent Application Publication (JP-A) No. 2003-505826 (Translation of Published International Application No. WO01/006602).

Here, the main portion is press-fitted into the terminal insertion hole formed in the body by pressing the bent portion. In other words, the bent portion need be exposed outside the body in such a manner as to receive the force to press-fit the main portion into the terminal insertion hole formed in the body. Such exposure of the bent portion outside the body may lead to impedance mismatches between the bent portion and the main portion covered with the body of a dielectric material.

The bent portion of the contact may be pushed into the terminal insertion hole formed in the body by using a special tool, but workability will worsens, leading to an increased cost.

In a case where contacts are arranged in two rows in a zigzag manner, respective bent portions of the contacts in a lower row are located next to lead-out portions of contacts in an upper row, but bent portions of the contacts in the upper row are located next to bent portions of the other contacts in the upper row. As a consequence, a distance between any two of the bent portions of the contacts in the upper row is about twice a distance between any one of the bent portions of the contacts in the lower row and an adjacent one of the lead-out portions of the contacts in the upper row.

An increased distance between the adjacent contacts reduces an electrostatic capacitance, resulting in an increased impedance. That is to say, impedances of the contacts in the upper row are larger than those of the contacts in the lower row, and therefore, impedance mismatches are apt to be created in each contact in the upper row, which is a factor to induce degradation of transmission characteristics.

SUMMARY OF THE INVENTION

The present invention has been made in the above circumstances. Objects of the present invention are to provide a contact in which a bent portion can be readily housed inside a body without using any special tool and to provide an electric connector using the same.

In order to solve the above-described problems, the present invention provides a substantially L-shaped contact to be inserted into and held in a terminal insertion hole formed in a body of an electric connector, the contact including: a main portion to be press-fitted into a terminal insertion hole formed in a body of an electric connector; a bent portion continuous to a portion of a rear end of the main portion; a lead-out portion continuous to a rear end of the bent portion; and an extension portion projecting from a remaining portion of the rear end of the main portion in a longitudinal direction of the main portion, the extension portion serving as a pressed portion to be inserted into the terminal insertion hole together with the bent portion.

In the above-described contact, the main portion is press-fitted into the terminal insertion hole by pressing the rear end of the extension portion, and further, the bent portion is inserted into the terminal insertion hole together with the extension portion. Consequently, the bent portion will not be exposed from the body, unlike the related art, thereby suppressing generation of an impedance mismatch between the main portion and the bent portion, so as to prevent degradation of transmission characteristics. Further, by pressing the rear end of the extension portion, the main portion, the extension portion and the bent portion can be inserted into the terminal insertion hole. Insertion of the contact into the terminal insertion hole is thus easy dispensing with any special tool.

It is preferable that the bent portion be disposed at the center of the rear end of the main portion; and the extension portion comprise a pair of extension portions arranged at outer ends of the rear end of the main portion. In this case, since the pair of extension portions is arranged outside the bent portion, it is easy to press the extension portions, thus facilitating a contact fixing work.

In the case where the bent portion is bent into a substantial L shape, each longitudinal length of the extension portions is greater than an outer bend radius of the bent portion. As a length of the extension portion is made greater than the outer bend radius of the bent portion, the entire bent portion can be inserted into the terminal insertion hole by pushing the extension portion into the terminal insertion hole formed in the body. Thus, there is a merit in preventing generation of impedance mismatches.

It is preferable that the contact should further include: a contact portion continuous to a tip end of the main portion and exposed from an end of the body; and a lead portion continuous to a rear end of the lead-out portion.

In the case where the bent portion and the lead-out portion are formed by being cut and raised from a plate-like body continuous to the rear end of the main portion, the extension portion is a remaining portion of the plate-like body left after cutting and raising the bent portion and the lead-out portion. Since the extension portion is formed of the remaining portion left after cutting out the bent portion and the lead-out portion in the above-described manner, a cost can be reduced in comparison with the case where an extension portion is independently formed.

An electric connector according to an aspect of the present invention includes a plurality of first contacts as described above; a plurality of second contacts of substantial L shapes; and an insulative body provided with the first and second contacts arranged in two rows in a zigzag manner. The second contact includes a main portion, a bent portion continuous to a rear end of the main portion, and a lead-out portion continuous to a rear end of the bent portion. The body has a plurality of first terminal insertion holes, extending from one end to the other end of the body and being aligned in a widthwise direction of the body so as to accommodate and hold the main portions, the extension portions and the bent portions of the respective first contacts; a plurality of second terminal insertion holes, extending from the one end to the other end of the body and being aligned with a phase shifted from that of the first terminal insertion hole so as to accommodate and hold therein the respective main portions of the second contacts; a plurality of first terminal insertion grooves formed in the other end at the same spacing as that of the first terminal insertion holes, the first terminal insertion grooves being adapted to accommodate and hold the respective lead-out portions of the first contacts; and a plurality of second terminal insertion grooves formed in the other end at the same spacing as that of the second terminal insertion holes, the second terminal insertion grooves being adapted to accommodate and hold the respective lead-out portions of the second contacts.

With the above-described electric connector, the main portions, the extension portions and the bent portions of the first contacts are contained and held in the first terminal insertion holes formed in the body. Furthermore, the lead-out portions of the first contacts are contained and held in the first terminal insertion grooves formed in the body. As a consequence, it is possible to prevent generation of an impedance mismatch in each of the first contacts, further preventing degradation of transmission characteristics.

An electric connector according to another aspect of the present invention includes a plurality of contacts as described in claim 1; and an insulative body provided with the contacts arranged in two rows in a zigzag manner. The body has a plurality of terminal insertion holes, extending from one end to the other end of the body and being arranged in two rows in a zigzag manner so as to accommodate and hold main portions, extension portions and bent portions of the respective contacts; and a plurality of terminal insertion grooves, formed in the other end at the same spacing as that of the terminal insertion holes so as to accommodate and hold respective lead-out portions of the contacts.

With the above-described electric connector, the main portions, the extension portions and the bent portions of, the contacts are contained and held in the terminal insertion holes formed in the body. Furthermore, the lead-out portions of the contacts are contained and held in the terminal insertion grooves formed in the body. As a consequence, it is possible to prevent generation of an impedance mismatch in each of the contacts, further preventing degradation of transmission characteristics.

BRIEF DESCRIPTION OF THE DRAWINGS

FIGS. 6A and 6B are views showing a part of a projecting portion of the body of the electric connector with the groups of contacts fixed thereto, wherein FIG. 6A is a schematic plan view and FIG. 6B is a schematic bottom view.

FIGS. 8A and 8B are views showing one of the contacts in an upper contact group in the electric connector, wherein FIG. 8A is a schematic perspective view and FIG. 8B is a schematic side view.

DETAILED DESCRIPTION OF THE PREFERRED EMBODIMENT

A description will be given below of an electric connector according to the embodiment of the present invention in reference to the attached drawings.

Figure 1:
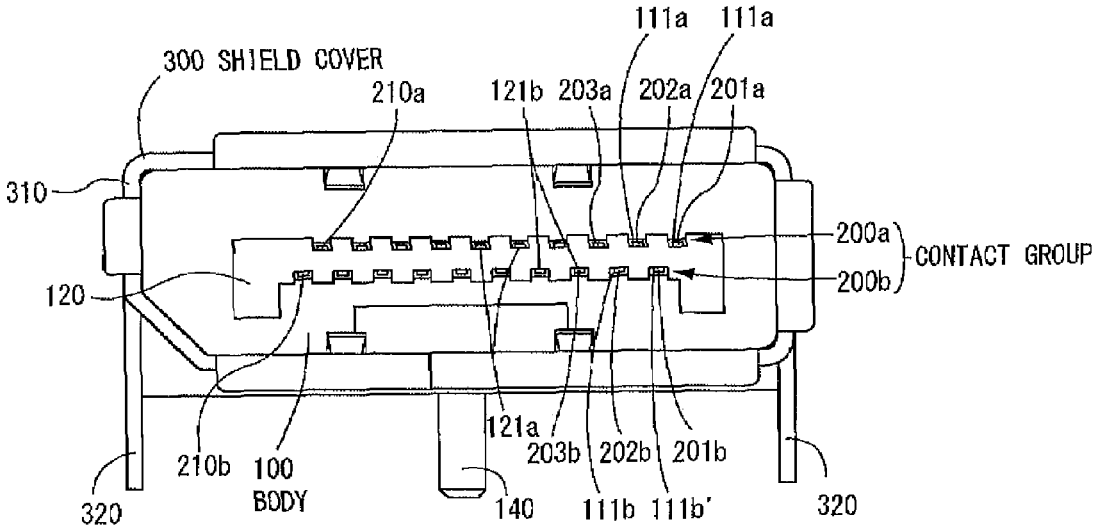
FIG. 1 is a front view schematically showing an electric connector according to an embodiment of the present invention.
Figure 2:
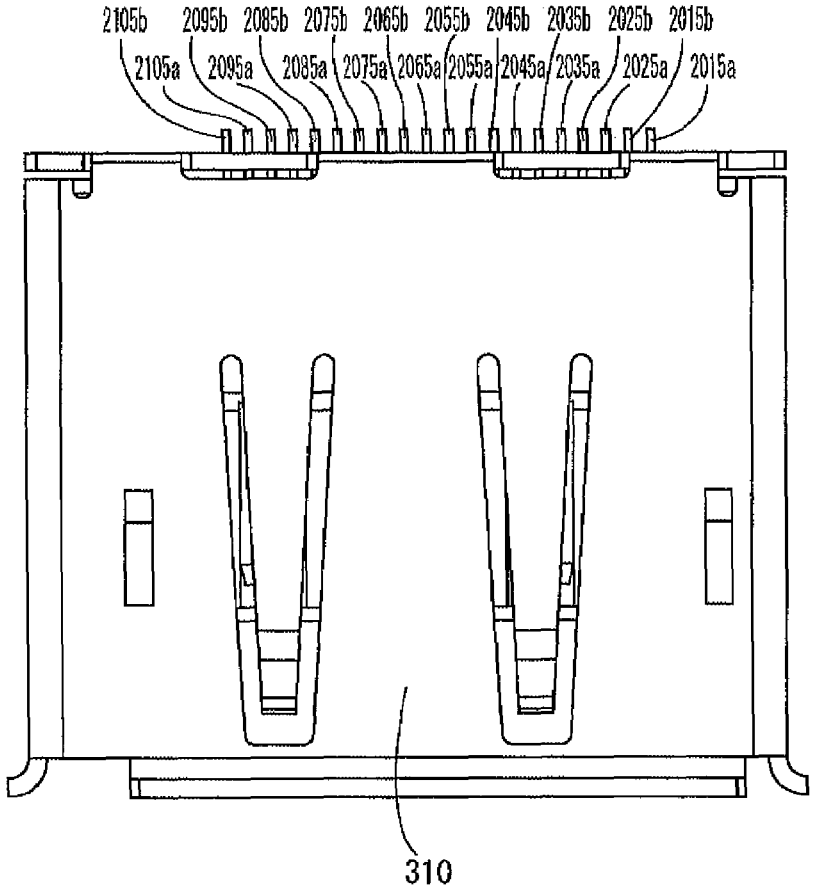
FIG. 2 is a plan view schematically showing the electric connector.
Figure 3:
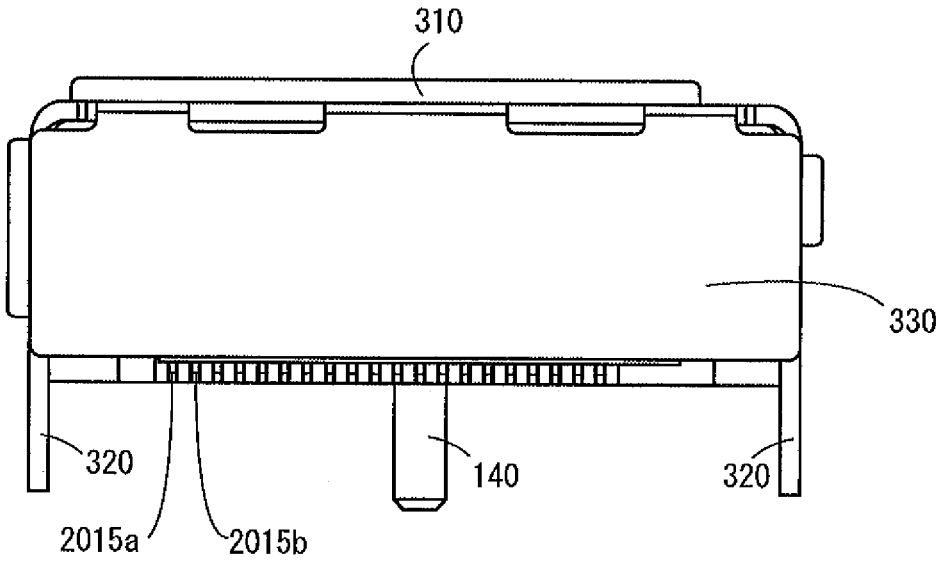
FIG. 3 is a back view schematically showing the electric connector.

An electric connector shown in FIGS. 1 to 3 is a board mounting type receptacle capable of coping with a high-speed differential transmission. The electric connector includes an insulative body 100, upper and lower contact groups 200*a* and 200*b* arranged with spacing in two rows in a zigzag manner in a widthwise direction inside the body 100, and a shield cover 300 shielding the periphery of the body 100. Hereinafter, descriptions will be made in detail on each of the elements.

Figure 4:
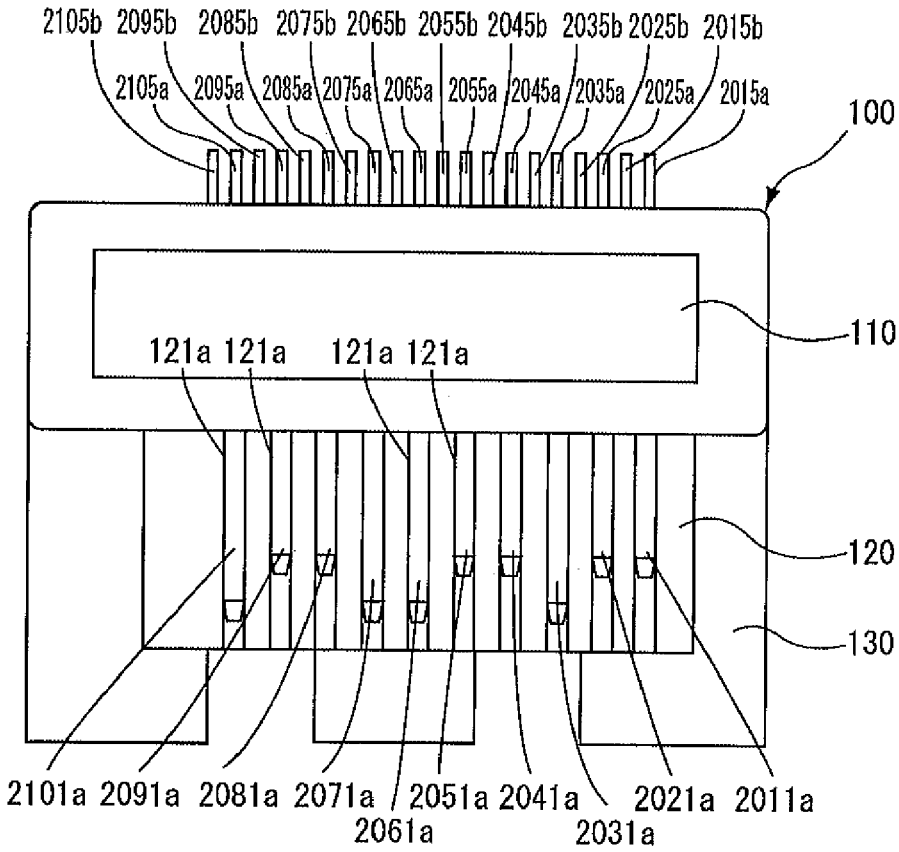
FIG. 4 is a plan view schematically showing a body having a group of contacts fixed thereto in the electric connector.
Figure 5:
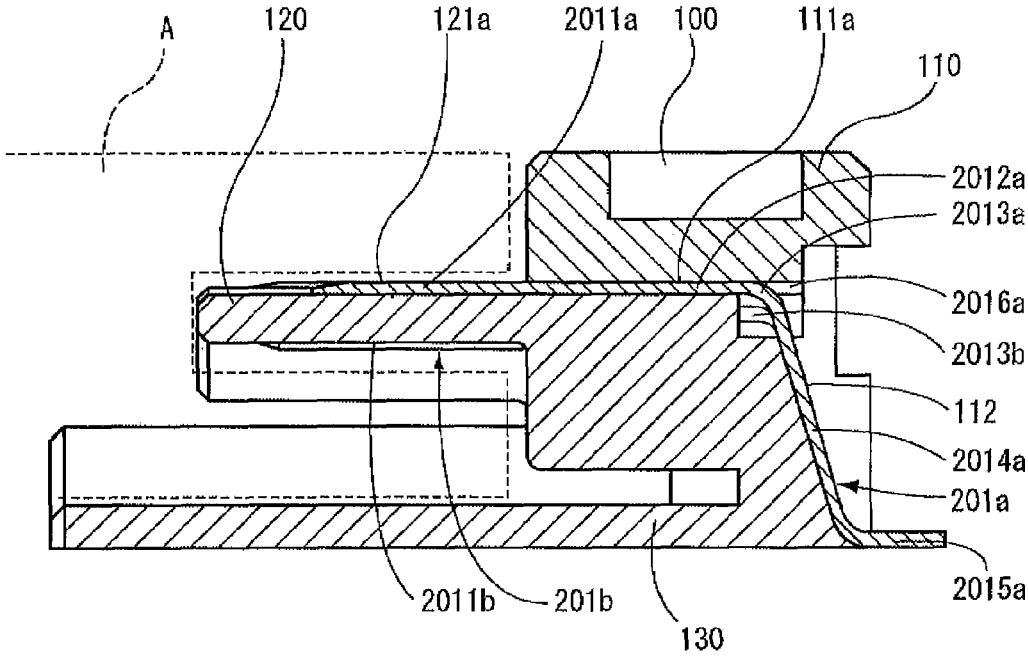
FIG. 5 is a cross-sectional view schematically showing the body of the electric connector with the group of contacts fixed thereto.

As shown in FIGS. 1, 4 and 5, the body 100 is formed by injection-molding a general-purpose synthetic resin such as PBT (polybutylene terephthalate) or PPS (polyphenylene sulfide). The body 100A can be mated with a plug A.

The body 100 includes: a main portion 110 of a substantially rectangular box shape; a projecting portion 120 of a substantially inverted U shape as viewed from the front, provided in front of the main portion 110 and adapted to be enter into a recess in a tip end of the plug A; a substantially plate-like base 130 provided under the main portion 110 and extended forward; and a columnar boss 140 formed downward on a bottom surface of the base 130 and fitted into a hole, not shown, formed in a printed circuit board.

As shown in FIGS. 1 and 5, in the center of the main portion 110 in the body 100, first and second terminal insertion holes 111*a* and 111*b* are arranged at equal pitches along a widthwise direction of the electric connector in a manner corresponding to contacts, not shown, of the plug A. These holes 111*a* and 111*b* are arranged in two rows that are spaced apart and shifted in phase with each other, that is, arranged in a staggered or zigzag manner. The widthwise ends of the first terminal insertion holes 111*a* are located in such plain positions as to overlap the widthwise ends of the second terminal insertion holes 111*b*.

The first and second terminal insertion holes 111*a* and 111*b* are the same horizontally elongated square through holes which pass from a front surface of the main portion 110 (one end of the body) to a back surface of the main portion 110 (the other end of the body). The first and second terminal insertion holes 111*a* and 111*b* are formed in the number of ten in the upper and lower rows, respectively so as to correspond to first and second main portions 2012*a* and 2022*b* in the upper and lower contact groups 200*a* and 200*b*, respectively.

Figure 7:
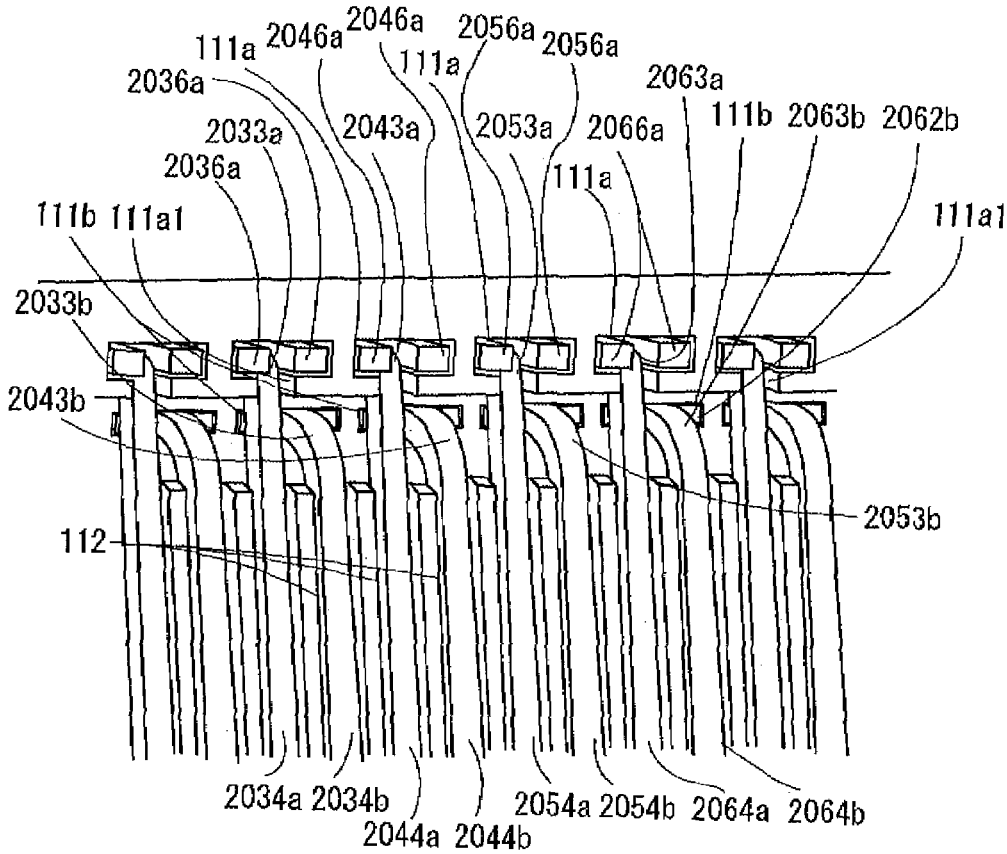
FIG. 7 is a partially enlarged perspective view showing a back surface of the body of the electric connector with the groups of contacts fixed thereto.

As shown in FIG. 7, at the center of a lower edge of each of the first terminal insertion holes 111*a*, there is a cutout 111*a*1 for leading out a first lead-out portion 2014*a* of a first contact 201*a*downward.

A back surface of the main portion 110A has a first step 113*a*, to which the ten first terminal insertion holes 111*a* are exposed, and a second step 113*b*, to which the ten second terminal insertion holes 111*b* are exposed and which is lower in height than the first step.

As shown in FIGS. 5 and 7, the back surface of the main portion 110A also has twenty terminal insertion grooves 112 (first and second terminal insertion grooves) extending in straight lines downward under the first and second terminal insertion holes 111*a* and 111*b*. The terminal insertion grooves 112 are elongated grooves having lateral widths corresponding to the lead-out portions 2014*a* and 2014*b* of the upper and lower contact groups 200*a* and 200*b*, and they are arranged in the widthwise direction.

Figure 6:
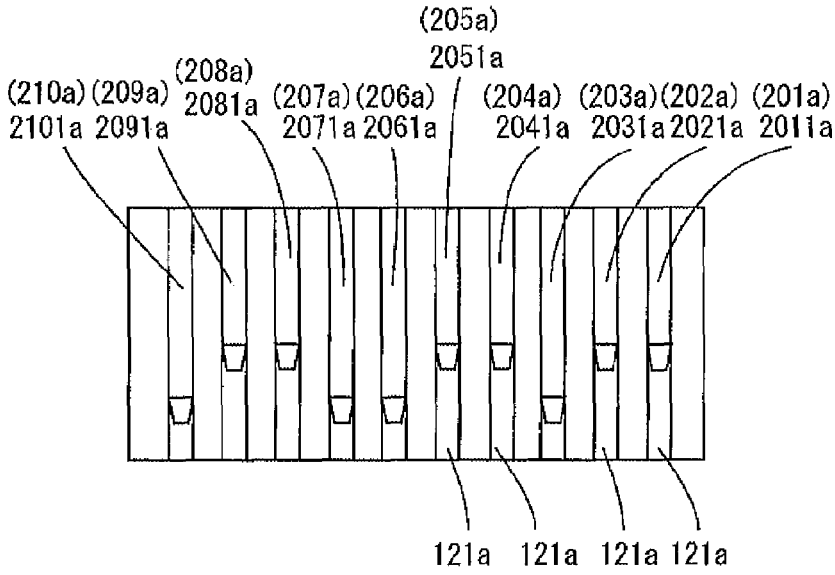
Figure 6:
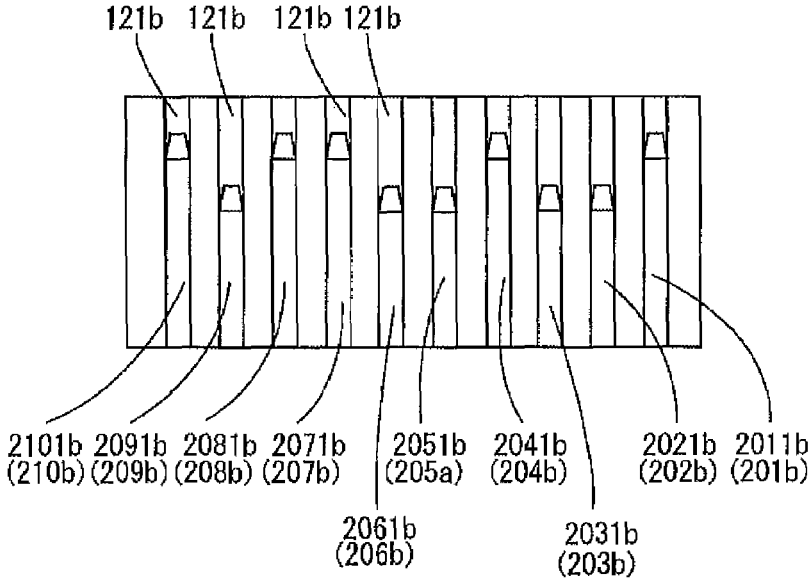

As shown in FIGS. 5 to 7, in an upper surface of the projecting portion 120 of the body 100, there are provided with terminal guide grooves 121*a*, extending in straight lines in a longitudinal direction of the body 100 and communicating with the first terminal insertion holes 111*a* of the main portion 110. In a lower surface of the projecting portion 120, there are terminal guide grooves 121*b*, extending in straight lines in a longitudinal direction of the body and communicating with the second terminal insertion holes 111*b* of the main portion 110. The terminal guide grooves 121*a* and 121*b* have lateral widths corresponding to contact portions 2011*a* and 2011*b* of the upper and lower contact groups 200*a* and 200*b*, respectively. The grooves 121*a* and 121*b* are arranged in the widthwise direction of the body and shifted phase, in a similar arrangement to the first and second terminal insertion holes 111*a* and 111*b*.

As shown in FIGS. 1, 2 and 3, the shield cover 300 is a metallic shell which can be brought into contact with a peripheral shield, not shown, of the plug A when fitted in the body 100. The shield cover 300 includes a cover body 310, a pair of legs 320 extending downward from opposite widthwise ends of the cover body 310, and a back cover 330 for openably covering an opening on the back side of the cover body 310.

The cover body 310, shaped as a substantially square cylinder, fits about the main portion 110 of the body 100 so as to cover four sides—upper, lower, right and left sides—of the main portion 110 and the projecting portion 120 (i.e., the peripheries of the main portion 110 and the projecting portion 120).

The legs 320 are inserted into fixing holes, not shown, formed in the printed circuit board, and are connected to a grounding pattern of the board.

The back cover 330 is a plate having an upper end turnably fixed to an upper edge of the opening on the back side of the cover body 310. The back cover 330 blocks this opening to shield the back surface of the main portion 110 of the body 100.

As shown in FIG. 6, the upper contact group 200*a* consists of first contacts 201*a*-210*a*. The lower contact group 200*b* consists of second contacts 201*b*-210*b*.

Figure 8:
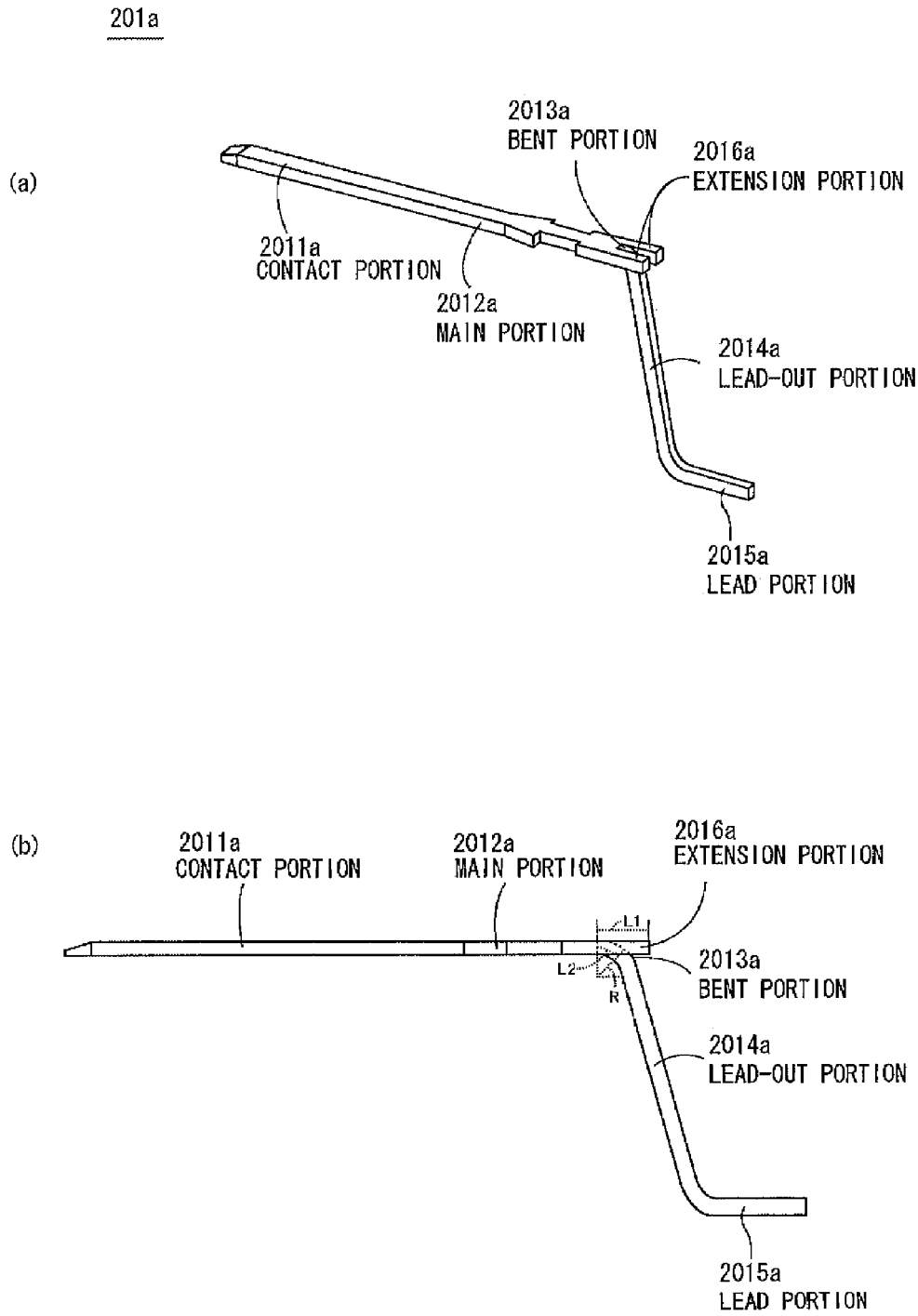

As shown in FIGS. 5 and 8, the first contact 201*a* includes: a first contact portion 2011*a* which can be brought into contact with a contact, not shown, of the plug A as fitted around the projecting portion 120 of the body 100; a first main portion 2012*a* which is disposed continuously to a rear end of the first contact portion 2011*a* and is adapted for press-fit into the first terminal insertion hole 111*a* in the body 100; a first bent portion 2013*a* which is disposed continuously to the center of a rear end of the first main portion 2012*a* and is bent downward; a first lead-out portion 2014*a* which is disposed continuously to a rear end of the first bent portion 2013*a* and extends along the back surface of the body 100; a first lead portion 2015*a* which is disposed continuously to a rear end of the first lead-out portion 2014*a* and bent at a substantially right angle so as to be connected to a pattern on the printed circuit board; and a pair of first extension portions 2016*a* of a rectangular box shape serving as pressed portions, which are disposed continuously to outer ends of the rear end of the first main portion 2012*a*.

The first contact portion 2011*a* and the first main portion 2012*a* are plates having substantially the same thickness. The first main portion 2012*a* is a plate wider than the first contact portion 2011*a*, and has projections for press-fitting work at widthwise ends thereof.

The first bent portion 2013*a* is a substantially L-shaped rod of almost one third the width of the first main portion 2012*a*. The first lead-out portion 2014*a* and the first lead portion 2015*a* are rods continuous to the bent portion 2013*a*.

The first extension portions 2016*a* are, as described later in detail, portions of the plate-like body left after cutting and raising the first bent portion 2013*a*, the first lead-out portion 2014*a* and the first lead portion 2015*a*. The first extension portions 2016*a* project in the bend direction of the first lead portion 2015*a*, that is, toward the lengthwise rear end of the first main portion 2012*a*.

The respective lengths L1 of the first extension portions 2016*a* are greater than an outer bend radius R of the first bent portion 2013*a*. In other words, the lengths L1 of the first extension portions 2016*a* are greater than a length L2 of a straight portion on the side of the first main portion 2012*a* out of two straight portions obtained by dividing the first bent portion 2013*a* at the bent position.

The above-described first contact 201*a* is fabricated by pressing a plate-like body having conductivity. More particularly, the plate-like body is cut to form the first contact portion 2011*a* and the first main portion 2012*a*. Furthermore, a pair of parallel slits is formed in the plate-like body continuous to the rear end of the first main portion 2012*a*. Outer portions of the pair of slits are cut off leaving some portions of the lengths. Then, the first bent portion 2013*a*, the first lead-out portion 2014*a*and the first lead portion 2015*a* are formed by bending a portion defined between the slits. The remaining portions outside the pair of slits serve as the pair of first extension portions 2016*a*.

Each of the first contacts 202*a*, 204*a*, 205*a*, 208*a* and 209*a* is identical to the first contact 201*a*. Moreover, each of the first contacts 203*a*, 206*a*, 207*a* and 210*a* is identical to the first contact 201*a*, except that their first contact portions 2031*a*, 2061*a*, 2071*a* and 2101*a* are each greater in length than the first contact portion 2011*a* of the first contact 201*a*.

Figure 9:
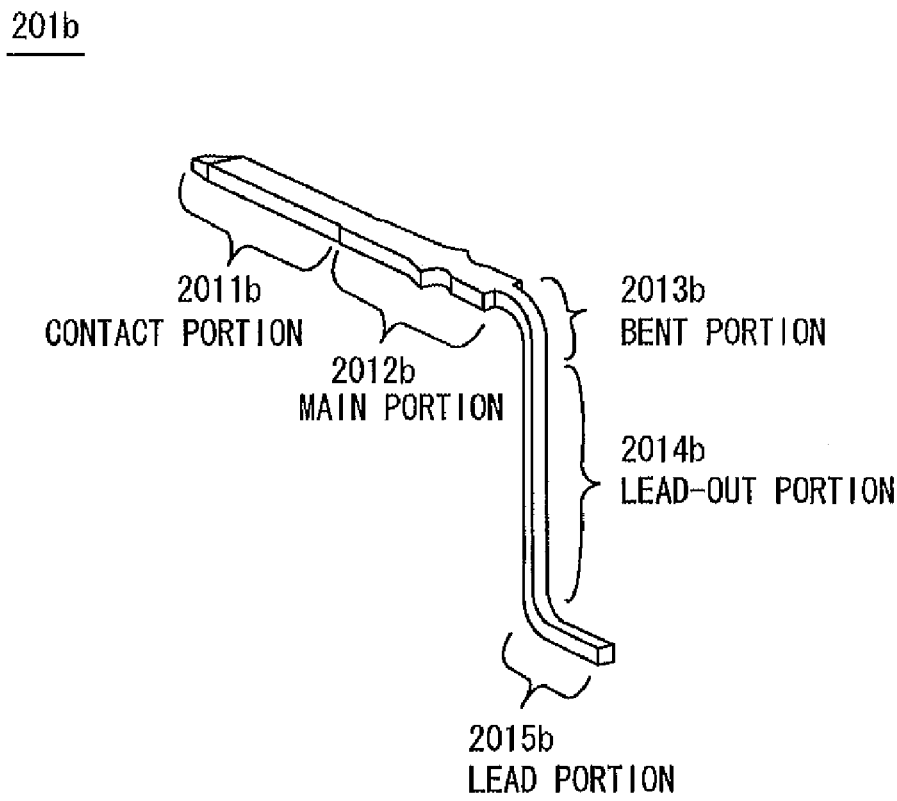
FIG. 9 is a perspective view schematically showing one of contacts in a lower contact group in the electric connector according to the embodiment of the present invention.

As shown in FIG. 9, the second contact 201*b* includes: a second contact portion 2011*b* which can be brought into contact with a contact, not shown, of the plug A as fitted around the projecting portion 120 of the body 100; a second main portion 2012*b* which is disposed continuously to a rear end of the second contact portion 2011*b* and is adapted for press-fit into the second terminal insertion hole 111*b* in the body 100; a second bent portion 2013*b* which is disposed continuously to a rear end of the second main portion 2012*b* and is bent at a substantially right angle; a second lead-out portion 2014*b* which is disposed continuously to a rear end of the second bent portion 2013*b* and extends along the back surface of the body 100; and a second lead portion 2015*b* which is disposed continuously to a rear end of the second lead-out portion 2014*b* and bent at a substantially right angle so as to be connected to a pattern on the printed circuit board.

The second contact portion 2011*b* and the second main portion 2012*b* are plates having substantially the same thickness. The second main portion 2012*b* is a plate wider than the second contact portion 2011*b*, and has projections for press-fitting work at widthwise ends thereof.

The second bent portion 2013*b* is a substantially L-shaped rod of almost one third the width of the second main portion 2012*b*. The second lead-out portion 2014*b* and the second lead portion 2015*b* are rods continuous to the second bent portion 2013*b*. The second lead-out portion 2014*b* is smaller in length than the first lead-out portion 2014*a*, as shown in FIG. 5, by a vertical difference defined between the first contact 201*a* and the second contact 201*b*.

The above-described second contact 201*b* is also fabricated by pressing a plate-like body having conductivity. More particularly, the plate-like body is cut to form the second contact portion 2011*b* and the second main portion 2012*b*. Furthermore, a pair of parallel slits is formed in the plate-like body continuous to the rear end of the second main portion 2012*b*. Outer portions of the pair of slits are cut off. Then, the second bent portion 2013*b*, the second lead-out portion 2014*b* and the second lead portion 2015*b* are formed by bending a portion defined between the slits.

Each of the second contacts 204*b*, 207*b*, 208*b* and 210*b* is identical to the second contact 201*b*. Moreover, each of the second contacts 202*b*, 203*b*, 205*b*, 206*b* and 209*b* is identical to the second contact 201*b*, except that their second contact portions 2021*b*, 2031*b*, 2051*b*, 2061*b* and 2091*b* are each smaller in length than the second contact portion 2011*b* of the second contact 201*b*.

The electric connector in the present embodiment is used as a power source line and also used for transmission of single end signals and first to fifth differential signals. The first and second contacts 207*a*, 210*a*, 207*b*, 209*b* and 210*b* are connected to a pattern on the printed circuit board, thereby functioning as contacts for power source line or contacts for transmitting the single end signals. On the other hand, as connected to the pattern on the printed circuit board, the first and second contacts 201*a*, 202*b*, 204*a*, 205*b* and 208*a* function as plus signal contacts for transmitting first to fifth differential signals; the first and second contacts 202*a*, 203*b*, 205*a*, 206*b* and 209*a* function as minus signal contacts for transmitting first to fifth differential signals; and the first and second contacts 201*b*, 203*a*, 204*b*, 206*a* and 208*b* function as common ground contacts for transmitting the first to fifth differential signals.

Among the upper and lower contact groups 200*a* and 200*b*, of special note are the first and second contacts (from 201*a* to 206*a*, 208*a*, 209*a*, from 201*b* to 206*b* and 208*b*) for transmitting first to fifth differential signals. As shown in FIG. 1, these contacts are disposed in five sets of triangular arrangements: each triangular set is formed by a plus signal contact and a minus signal contact disposed at the bottom and a common ground contact at the top on the cross-sectional plain of the body 100. These five sets are arranged in sequence in the widthwise direction of the body 100 with their vertical orientations alternately inverted.

In the electric connector in the present embodiment, the contacts for signal transmission and other contacts are arranged in the above-described relationship. Therefore, in order just to reduce a skew, etc. between adjacent contacts of each differential pair and between the differential pairs, the longitudinal relationship among the first contact portions 2011*a*-2111*a* of the first contacts 201*a*-210*a* and the second contact portions 2011*b* to 2111*b* of the second contacts 201*b*-210*b* is established as shown in FIGS. 6A and 6B.

A description will be given below of procedures for fixing the upper contact group 200*a* and the lower contact group 200*b* to the body 100.

First of all, the second contact portions 2011*b*-2101*b* of the second contacts 201*b*-210*b* are positioned and inserted into the respective ten second terminal insertion holes 111*b* formed in the body 100 from the back side of the body 100. In this state, the second bent portions 2013*b*-2103*b* of the second contacts 201*b*-210*b* are pressed toward the respective second terminal insertion holes 111*b*. And then, the second main portions 2012*b*-2102*b* of the second contacts 201*b*-210*b* are press-fitted into the ten second terminal insertion holes 111*b*, respectively. Furthermore, the second contact portions 2011*b*-2101*b* of the second contacts 201*b*-210*b* are inserted into the respective ten terminal guide grooves 121*b* formed in the body 100, and the second lead-out portions 2014*b*-2104*b* are inserted into the respective ten terminal insertion holes 112.

Thereafter, the first contact portions 2011*a*-2101*a* of the first contacts 201*a*-210*a* are positioned and inserted into the respective ten first terminal insertion holes 111*a* formed in the body 100 from the back side of the body 100. In this state, the pairs of first extension portions 2016*a*-2106*a* of the first contacts 201*a*-210*a* are pressed toward the respective first terminal insertion holes 111*a*. And then, the first main portions 2012*a*-2102*a* of the first contacts 201*a*-210*a* are press-fitted to be disposed toward the respective tip ends of the ten first terminal insertion holes 111*a*; in the meantime, the pairs of first extension portions 2016*a*-2106*a* and the first bent portions 2013*a*-2103*a* are inserted to be disposed toward the respective rear ends of the first terminal insertion holes 111*a*. Furthermore, the first contact portions 2011*a*-2101*a* of the first contacts 201*a*-210*a* are inserted into the respective ten terminal guide grooves 121*a* formed in the body 100, and the first lead-out portions 2014*a*-2103*a* are inserted into the respective remaining ten terminal insertion holes 112.

In this manner, when the first bent portions 2013*a*-2103*a* are inserted into the first terminal insertion holes 111*a*, then upper, lower, right and left surfaces of the first bent portions 2013*a*-2103*a* are surrounded by the four walls at the rear ends of the first terminal insertion holes 111*a*.

In the upper contact group 200*a* and the lower contact group 200*b* fixed to the body 100 in the above-described manner, as shown in FIGS. 1 and 6, the widthwise ends of the main portions 2012*a*-2102*a* of the first contacts 201*a*-210*a* are located in such plain positions as to overlap the widthwise ends of the main portions 2012*b*-2102*b* of the second contacts 201*b*-210*b*.

As a consequence, in any one of the common ground contacts, opposite widthwise ends of the main portion are located in such plain positions as to overlap a widthwise end of the main portion of the adjacent plus signal contact and a widthwise end of the main portion of the minus signal contact. In addition, adjacent to these plus signal contact and minus signal contact, the common ground contacts in other sets are arranged. This arrangement of the contacts achieves excellently matched impedances in the respective differential pairs of contacts.

In the above-described electric connector, the pairs of first extension portions 2016*a*-2106*a* of the first contacts 201*a*-210*a* are pushed into the rear ends of the first terminal insertion holes 111*a*, so that the first bent portions 2013*a* of the first contacts 201*a*-210*a* are inserted into the rear ends of the first terminal insertion holes 111*a* together with the pairs of first extension portions 2016*a*-2106*a*. In the case where the bent portions of the upper contact are exposed from the back surface of the body 100, the characteristic impedance is about 115 Ω between contacts of a differential pair. In the above embodiment, the characteristic impedance can be set at about 100 Ω, which is a differential impedance under certain standards, achieving an excellent impedance matching.

Here, the above-described contact may be changed in design as long as it is a substantially L-shaped contact to be inserted into and held in a terminal insertion hole formed in a body of an electric connector, the contact including a main portion to be press-fitted into the terminal insertion hole formed in the body; a bent portion continuous to a portion of a rear end of the main portion; a lead-out portion continuous to a rear end of the bent portion; and an extension portion projecting from a remaining portion of the rear end of the main portion in a longitudinal direction of the main portion, the extension portion serving as a pressed portion to be inserted into the terminal insertion hole together with the bent portion.

For example, the bent portion may be disposed at one widthwise end at the rear end of the main portion, and the extension portion may be disposed at the widthwise other end at the rear end of the main portion.

The shape of the extension portion may be changed in design as long as it projects in the longitudinal direction of the main portion. For example, the extension portion may be formed like a rod projecting from the rear end of the main portion, and such extension portion may be inserted into a recess formed in the main portion.

The extension portion should have a length such that at least a portion of the bent portion can be inserted into the terminal insertion hole formed in the body. Even in this case, it is possible to suppress any impedance mismatches generated between the main portion and the bent portion.

The shape of the main portion may be changed in design as long as it can be press-fitted into the terminal insertion hole formed in the body. The shapes of the contact portion, lead-out portion and lead portion may also be changed in design.

It is optional whether to provide the contact with the contact portion or the lead portion. In other words, the main portion may function partly as the contact portion whereas the lead-out portion may function partly as the lead portion.

Incidentally, the contact is not limited for use as a contact for a differential type transmission system, but may be applied to a contact of other types, such as a contact for an unbalanced (i.e., single end) type transmission system.

The above-described connector may be changed in design as long as it is provided with the contacts and the body having the terminal insertion holes for housing and holding the contacts.

As a consequence, the contacts may be arranged in any different manner. If the connectors are differential signal transmission type electric connectors, it is preferable to arrange the contacts in sequence in the widthwise direction in triangularly arranged sets, each of the set consisting of a plus signal contact, a minus signal contact and a common ground contact. However, the arrangement of the contacts is not limited to this.

Additionally, although it is described in the embodiment that the first contacts and the second contacts are arranged in the upper and lower rows, respectively, the first contacts may be arranged in two rows in a zigzag manner. In this case, the bent portions of the lower contacts can also be inserted into the terminal insertion holes in the body together with the extension portions, so that there is a merit in impedance matching. Here, the contacts may be arranged in three or more rows. It should be noted the contacts are not necessarily be in the zigzag arrangement.

Although it is described in the embodiment that the electric connector serves as a receptacle, it may serve as a plug having cables connected to contacts.

What is claimed is:

1. A substantially L-shaped contact to be inserted into and held in a terminal insertion hole formed in a body of an electric connector, the contact comprising:

a main portion to be press-fitted into a terminal insertion hole formed in a body of an electric connector, the main portion having a first end on a contact insertion direction side and a second end on an opposite direction side to the contact insertion direction;

a bent portion of a substantial L share, continuous to a portion of the second end of the main portion;

a lead-out portion continuous to a lower end of the bent portion; and an extension portion projecting from a remaining portion of the second end of the main portion in the opposite direction, the extension portion serving as a pressed portion to be inserted into the terminal insertion hole together with the bent portion, wherein the bent portion has two straight parts defined by dividing the bent portion at a bent point thereof, and the extension portion is larger in length than one of the straight parts on a main portion side.

2. An electric connector comprising:

a plurality of first contacts as described in claim 1;

a plurality of second contacts of substantial L shapes; and an insulative body provided with the first and second contacts arranged in two rows in a zigzag manner;

the second contact including a main portion having a first end on the insertion direction side and a second end on the opposite direction side, a bent portion continuous to the second end of the main portion, and a lead-out portion continuous to the lower end of the bent portion; and the body having:

a plurality of first terminal insertion holes, extending from one end to the other end of the body and being aligned in a widthwise direction of the body so as to accommodate and hold the main portions, the extension portions and the bent portions of the respective first contacts;

a plurality of second terminal insertion holes, extending from the one end to the other end of the body and being aligned with a phase shifted from that of the first terminal insertion hole so as to accommodate and hold therein the respective main portions of the second contacts;

a plurality of first terminal insertion grooves formed in the other end at the same spacing as that of the first terminal insertion holes, the first terminal insertion grooves being adapted to accommodate and hold the respective lead-out portions of the first contacts; and a plurality of second terminal insertion grooves formed in the other end at the same spacing as that of the second terminal insertion holes, the second terminal insertion grooves being adapted to accommodate and hold the respective lead-out portions of the second contacts.

3. An electric connector comprising:

a plurality of contacts as described in claim 1; and an insulative body provided with the contacts arranged in two rows in a zigzag manner;

the body having:

a plurality of terminal insertion holes, extending from one end to the other end of the body and being arranged in two rows in a zigzag manner so as to accommodate and hold main portions, extension portions and bent portions of the respective contacts; and a plurality of terminal insertion grooves, formed in the other end at the same spacing as that of the terminal insertion holes so as to accommodate and hold respective lead-out portions of the contacts.

4. A contact according to claim 1, wherein the bent portion is disposed at a center of the second end of the main portion; and the extension portion comprises a pair of extension portions arranged at outer ends of the second end of the main portion.

5. A contact according to claim 4, wherein the bent portion and the lead-out portion are formed by being cut and raised from a plate-like body continuous to the second end of the main portion; and the extension portion is a remaining portion of the plate-like body left after cutting and raising the bent portion and the lead-out portion.

6. A contact according to claim 4, further comprising:

a contact portion continuous to the first end of the main portion and exposed from an end of the body, in use; and a lead portion continuous to a lower end of the lead-out portion.

* * * * *